US008297620B1

(12) United States Patent
Qubty

(10) Patent No.: US 8,297,620 B1
(45) Date of Patent: Oct. 30, 2012

(54) MARBLE BOARD GAME

(76) Inventor: Aleigh Qubty, York, NE (US)

( * ) Notice: Subject to any disclaimer, the term of this patent is extended or adjusted under 35 U.S.C. 154(b) by 0 days.

(21) Appl. No.: 13/405,793

(22) Filed: Feb. 27, 2012

(51) Int. Cl.
*A63F 3/00* (2006.01)

(52) U.S. Cl. ..... 273/287; 273/249; 273/171

(58) Field of Classification Search ..... 273/249, 273/243, 271, 287
See application file for complete search history.

(56) References Cited

U.S. PATENT DOCUMENTS 2,419,000 A 4/1947 Ashworth
2,460,264 A 1/1949 Prentice
3,181,867 A 5/1965 Dreyer
3,709,497 A 1/1973 Barlow
3,762,714 A 10/1973 Wilson
3,865,381 A * 2/1975 Hayes ..... 273/256
4,334,680 A * 6/1982 Liversidge ..... 273/440
4,422,644 A 12/1983 Holahan et al.
5,201,524 A 4/1993 Csanady et al.
5,505,455 A * 4/1996 Kamrath et al. ..... 273/248

* cited by examiner

*Primary Examiner* — Vishu K. Mendiratta
(74) *Attorney, Agent, or Firm* — Dennis L. Thomte; Thomte Patent Law Office LLC

(57) ABSTRACT

A marble board game which may be played by two to four players. In one embodiment, the game board includes an orange player's station, a red player's station, a blue player's station and a white player's station. The object of the game is to move a player's marbles from their colored box into a start position and then across the board to the opponent's station. In another embodiment, the game board includes only two player's stations.

18 Claims, 4 Drawing Sheets

MARBLE BOARD GAME

BACKGROUND OF THE INVENTION

1. Field of the Invention

This invention relates to a marble board game including a novel game board with the game being played by two to four players.

2. Description of the Related Art

Many marble games and game boards have been previously designed with some of those being patented.

U.S. Pat. No. 2,419,000 discloses a game wherein the opening 6 in the upper portion of the board may be brought into alignment with bores 12 in the tubes 9.

U.S. Pat. No. 2,460,264 discloses a game board wherein openings may be brought into alignment with one another to receive game pieces.

U.S. Pat. No. 3,181,867 discloses registering openings in which a ball may pass.

U.S. Pat. No. 3,709,497 discloses a marble-type board game apparatus wherein a marble can drop through aligned openings.

U.S. Pat. No. 3,762,714 discloses a game board.

U.S. Pat. No. 4,422,644 discloses a board game apparatus wherein apertures may be aligned.

To date, it appears that no one has previously provided a marble game and game board wherein the winner must lose to win.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

The marble game board of this invention is designed to be played by two to four players. The game board of this invention includes a horizontally disposed bottom wall having a first side edge, a second side edge, a third side edge and a fourth side edge. First, second, third and fourth upstanding side walls extend upwardly from the first, second, third and fourth side edges of the bottom wall respectively. A horizontally disposed playing board extends between the upper ends of the first, second, third and fourth side walls to define a compartment between the playing board and the bottom wall.

The playing board has a first side, a second side, a third side, a fourth side, an upper surface and a lower side. Each of the side walls of the playing board have a marble retrieving opening formed therein. Marble return structures are provided in the compartment between the playing board and the bottom wall for returning marbles to the respective marble retrieving openings.

A first colored box is provided on the upper surface of the playing board adjacent the first side thereof which is adapted to receive a plurality of marbles therein having a first color. A second colored box is provided on the upper surface of the playing board adjacent the second side thereof which is adapted to receive a plurality of marbles therein having a second color. A third colored box is provided on the upper surface of the playing board adjacent the third side thereof which is adapted to receive a plurality of marbles therein having a third color. A fourth colored box is provided on the upper surface of the playing board adjacent the fourth side thereof which is adapted to receive a plurality of marbles therein having a fourth color. A first winner's box is provided on the upper surface of the playing board adjacent the first side thereof which is adapted to receive marbles therein. A second winner's box is provided on the upper surface of the playing board adjacent the second side thereof which is adapted to receive marbles therein. A third winner's box is provided on the upper surface of the playing board adjacent the third side thereof which is adapted to receive marbles therein. A fourth winner's box is provided on the upper surface of the playing board adjacent the fourth side thereof which is adapted to receive marbles therein.

First, second, third and fourth players stations are provided on the upper surface of the playing board adjacent the first, second, third and fourth sides thereof respectively. The first player's station includes a start position adapted to have a plurality of the marbles of the first color positioned therein in a spaced-apart manner. The second player's station includes a start position adapted to have a plurality of the marbles of the second color positioned therein in a spaced-apart manner. The third player's station includes a start position adapted to have a plurality of the marbles of the third color positioned therein in a spaced-apart manner. The fourth player's station includes a start position adapted to have a plurality of the marbles of the fourth color positioned therein in a spaced-apart manner.

Each of the first, second, third and fourth player's stations include a plurality of spaced-apart rows of spaced-apart marble holes which are formed in the playing board. The rows of the marble holes in the player's stations are parallel to the associated side of the playing board. Each of the rows of marble holes in the player's station having an outer row, an inner row, and intermediate rows.

The playing board has a center marble hole positioned at the center thereof. The first player's station includes a plurality of aligned marble holes formed in the playing board which are positioned between the center marble hole and the center of the inner row of marble holes thereof. The second player's station includes a plurality of aligned marble holes formed in the playing board which are positioned between the center marble hole and the center of the inner row of marble holes thereof. The third player's station includes a plurality of aligned marble holes formed in the playing board which are positioned between the center marble hole and the center of the inner row of marble holes thereof. The fourth player's station includes a plurality of aligned marble holes formed in the playing board which are positioned between the center marble hole and the center of the inner row of marble holes thereof.

At least some of the marble holes in the rows of marble holes of the first, second, third and fourth player's stations are closed to prevent a marble from passing downwardly therethrough into the compartment therebelow. At least some of the marble holes in the rows of marble holes of the first player's station are open to the compartment therebelow whereby a marble placed therein will fall into the compartment therebelow and be returned to the first marble retrieving opening by the first marble return structure for subsequent manual return to the first colored box for further play. At least some of the marble holes in the rows of marble holes of the second player's station are open to the compartment therebelow whereby a marble placed therein will fall into the compartment therebelow and be returned to the second marble retrieving opening by the second marble return structure for subsequent manual return to the second colored box for further play. At least some of the marble holes in the rows of marble holes of the third player's station are open to the compartment therebelow whereby a marble placed therein will fall into the compartment therebelow and returned to the third marble retrieving opening by the third marble return structure for subsequent manual return to the third colored box for further play. At least some of the marble holes in the rows of marble holes of the fourth player's station are open to the compartment therebelow whereby a marble placed therein will fall into the compartment therebelow and be returned to the fourth marble retrieving opening by the fourth marble return structure for subsequent manual return to the fourth colored box for further play.

At least some of the marble holes which extend from the inner rows of marble holes of the first, second, third and fourth player's stations are closed and wherein some of those holes are open. The board game of this invention includes a die at each player's station with each die having at least one blank face. The numbers on the faces of each of the die are varied. The marble holes which are closed have the same color as the compartment therebelow and so that those marble holes which are open will appear to be closed.

The rules for playing the game are disclosed hereinafter.

It is therefore a principal object of the invention to provide a novel marble game.

A further object of the invention is to provide a unique game board for a marble game.

A further object of the invention is to provide a novel marble game wherein a player must lose to win.

A further object of the invention is to provide a marble game which may be played by two to four players.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
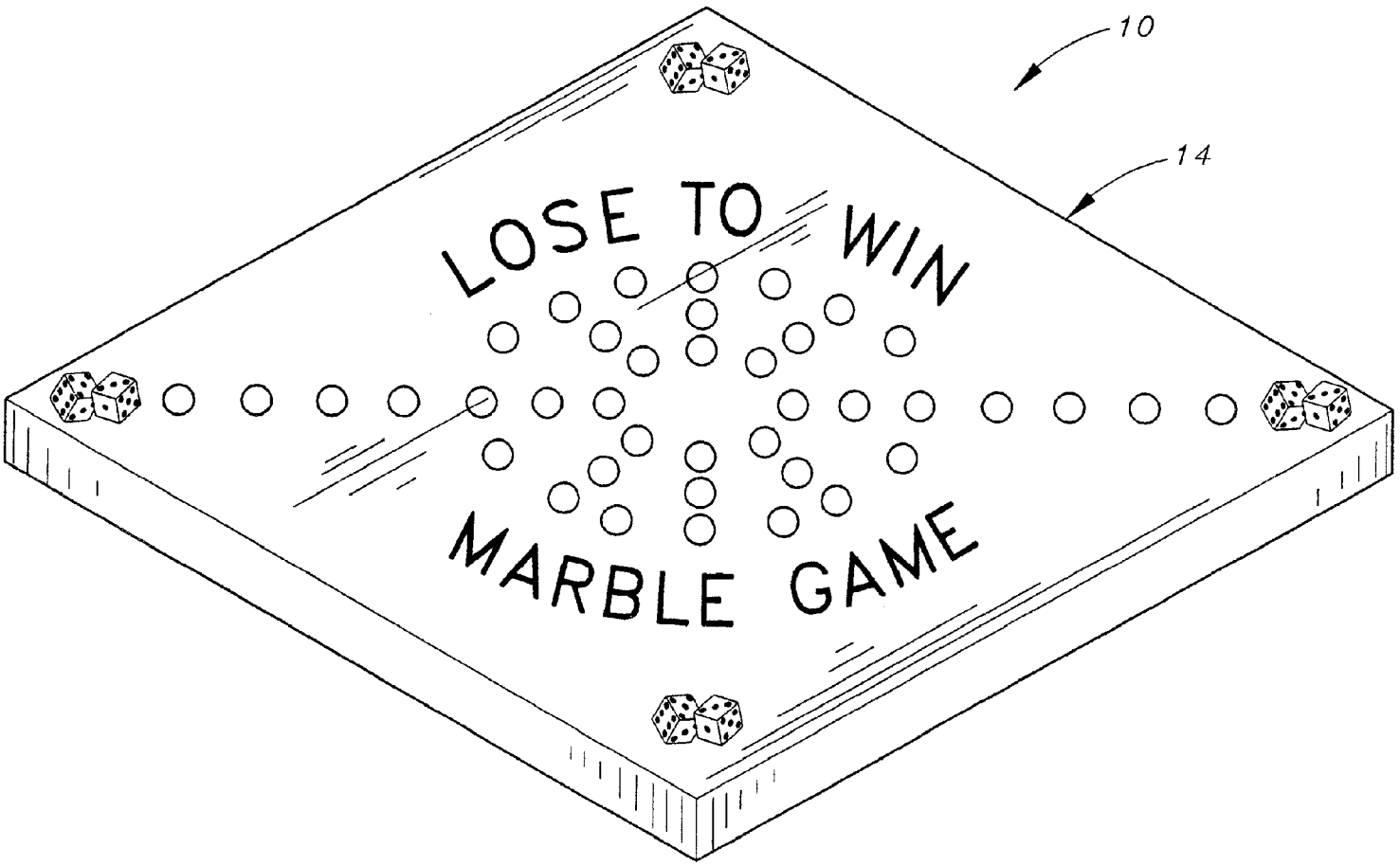
FIG. 1 is a perspective view of the cover of the marble game of this invention.
Figure 2:
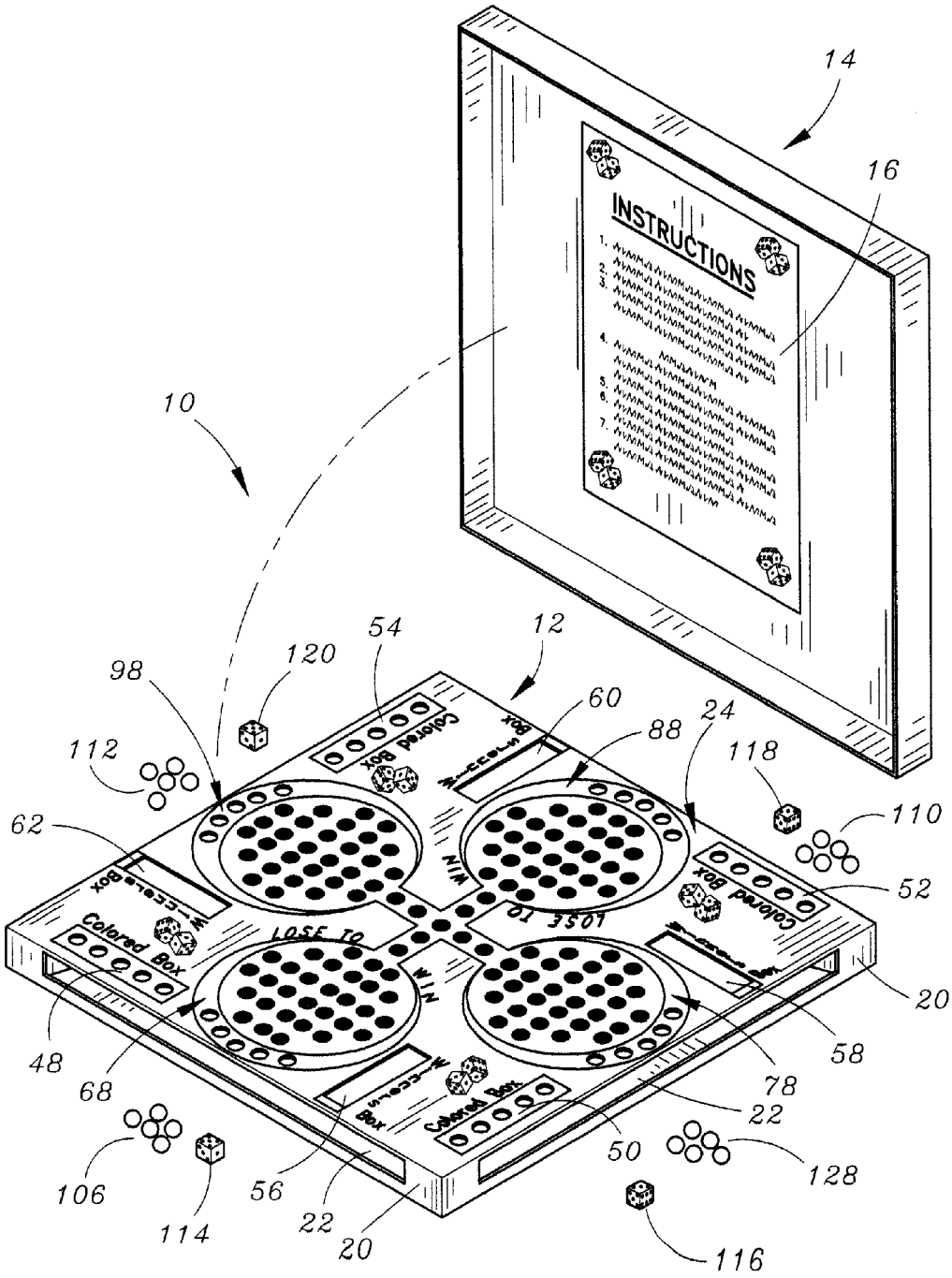
FIG. 2 is an exploded perspective view illustrating the cover of the game being removed from the playing board.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The marble game of this invention is referred to by the reference numeral 10. Game 10 includes a base or bottom portion 12 and a cover or lid 14. Preferably, the underside of the cover 14 has the game instructions 16 appearing thereon. Bottom portion 12 includes a bottom wall 18 having four upstanding side walls 20 extending upwardly therefrom. Each of the side walls 20 has a marble retrievable opening 22 formed therein. A game board or playing board 24 extends between the upper ends of the side walls 20 to define a compartment 25 below the playing board 24.

Triangular shaped, inclined or sloped ramps 26, 28, 30 and 32 are positioned beneath the playing board 24 which extend from the center of the playing board 24 to the four retrievable openings 22 respectively. Upstanding walls 34 and 36 are positioned at the side edges of ramp 26. Upstanding walls 38 and 40 are positioned at the side edges of the ramp 28. Upstanding side walls 41 and 42 are positioned at the side edges of ramp 30. Upstanding side walls 44 and 46 are positioned at the side edges of ramp 32.

Figure 3:
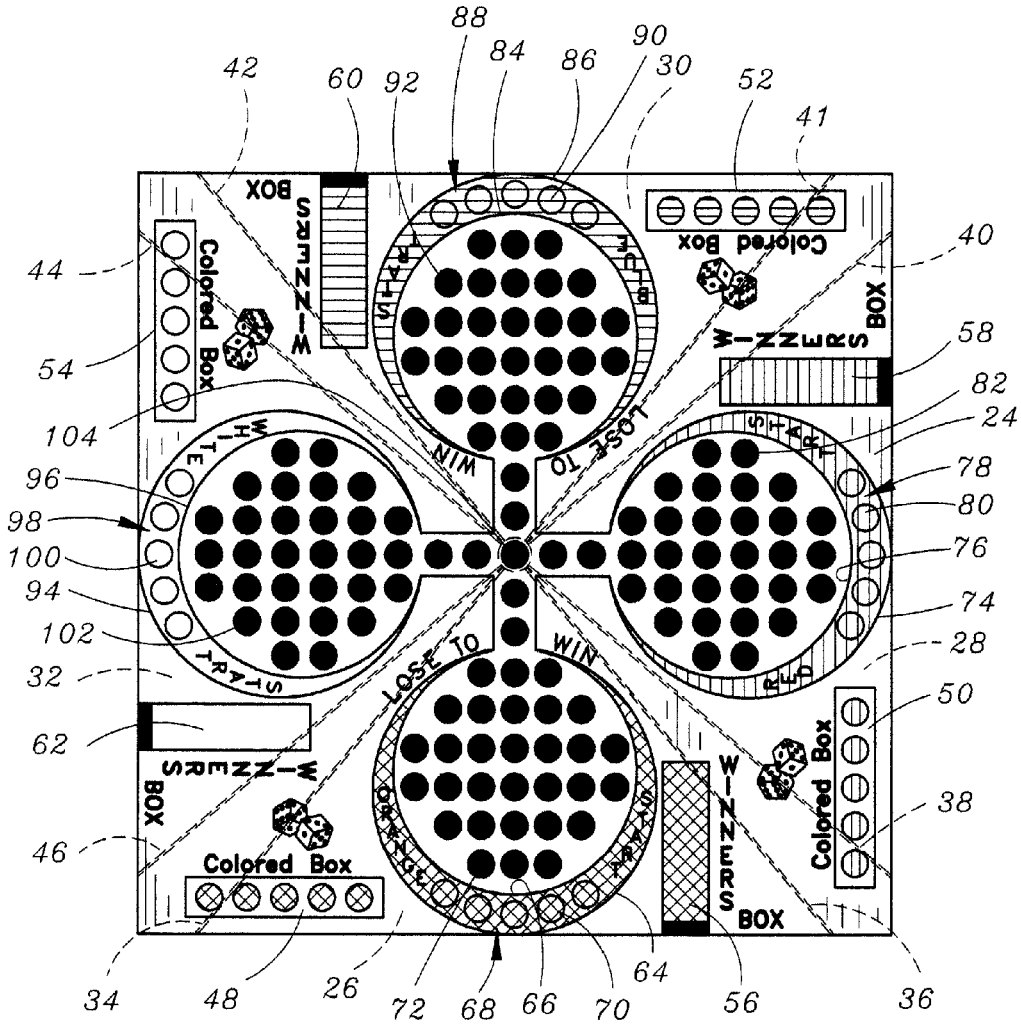
FIG. 3 is a top elevational view of the game board of this invention.
Figure 4:
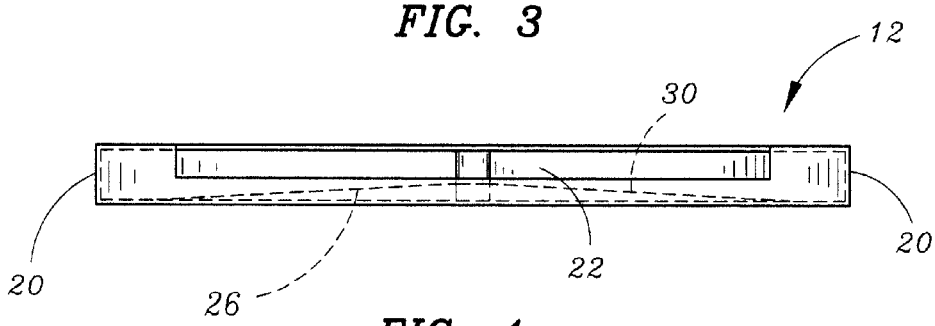
FIG. 4 is a side elevational view of the game board of this invention.

Colored boxes 48, 50, 52 and 54 are provided on playing board 24 with each of the boxes having five marble spots associated therewith adapted to receive and support marbles therein. Winner's boxes 56, 58, 60 and 62 are also provided on playing board 24 as seen in FIG. 3. The winner's boxes are slightly indented so that marbles placed therein will not roll therefrom.

Between the orange colored box 48 and the orange winner's box 56 are two circles 64 and 66 which define an orange start position 68 having five marble spots, holes or recesses 70. Within circles 66 are 30 marble holes 72 in rows of three, five, seven, seven, five and three marbles.

Between the red colored box 50 and the red winner's box 58 are two circles 74 and 76 which define a red start position 78 having five marble holes 80. Within circle 76 are 30 marble holes 82 in rows of three, five, seven, seven, five and three marble holes.

Between the blue colored box 52 and the blue winner's box 60 are two circles 84 and 86 which define a blue start position 88 having five marble holes 90. Within circle 86 are 30 marble holes 92 in rows of three, five, seven, seven, five and three marble holes.

Between the white colored box 54 and the white winner's box 62 are two circles 94 and 96 which define a white start position 98 having five marble holes 100. Within circle 96 are 30 marble holes 102 in rows of three, five, seven, seven, five and three marble holes.

Five orange marbles 106 are used by the player at the orange player's station and five red marbles 108 are used by the player at the red player's station. Five blue marbles 110 are used by the player at the blue player's station and five white marbles 112 are used by the player at the white player's station. An orange die 114 is used by the player at the orange player's station and a red die 116 is used by the player at the red player's station. A blue die 118 is used by the player at the blue player's station and a white die 120 is used by the player at the white player's station. Initially, the orange marbles 106 will be placed in the colored box 48 and the red marbles 108 will be placed in the colored box 50. Initially, the blue marbles 110 will be placed in the blue colored box 52 and the marbles 112 will be placed in the white colored box 54.

As seen in FIG. 3, a pair of marble holes are positioned between the center marble hole 104 and the center of the innermost row of marble holes 72 at the orange player's station. As also seen in FIG. 3, a pair of marble holes are positioned between the center marble hole 104 and the center of the innermost row of marbles 82 at the red player's station. As also seen in FIG. 3, a pair of marble holes are positioned between the center marble hole 104 and the center of the innermost row of marble holes 92 at the blue player's station. Further, it can be seen from FIG. 3 that a pair of marble holes are provided between the center marble hole 104 and the center of the innermost row of marble holes 102 at the white player's station.

Figure 5:
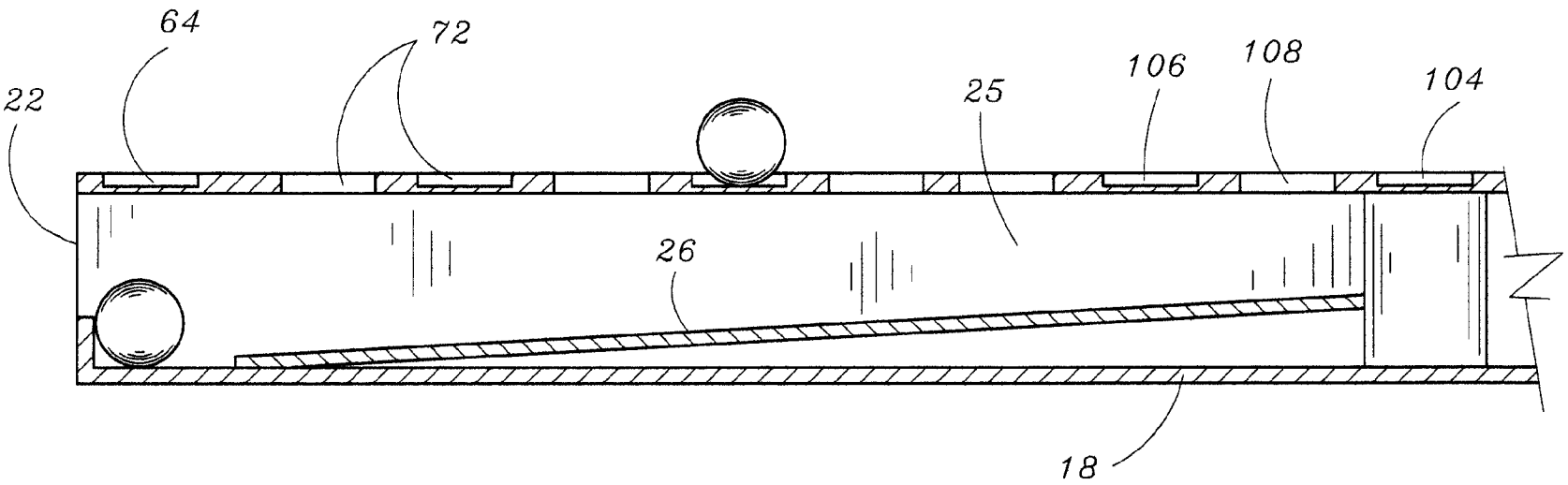
FIG. 5 is a partial sectional view of the game board.

At least some of the marble holes 72, 82, 92 and 102 are closed as seen in FIG. 5. At least some of the marble holes 72, 82, 92 and 102 are open so that a marble placed therein will drop downwardly through the marble hole into the compartment 25 therebelow. A marble dropping through one of the marble holes 72 to the compartment 25 will be returned to the marble retrieving opening 22 formed in the side wall 20 by the sloped ramp 26. Similarly, any marbles dropping through the openings 82, 92 and 102 into the compartment 25 therebelow will be returned to the respective player's station by the ramps 28, 30 and 32 respectively. Preferably, the center opening 104 is closed so that a marble placed therein will not drop into the compartment 25. Preferably, one of the openings of the pair of openings which extend towards the center opening 104 will also be opened to the compartment 25 therebelow.

With respect to the dice 114, 116, 118 and 120, some of the faces thereof are blank. The numbers on the orange die 114 are one, two, three, four and five. The numbers on the red die 116 are one, two, three, four and six. The numbers on the blue die 118 are one, three, four and five. The numbers on the white die 120 are one, two, three, four and five.

Those marble holes which are closed are painted or colored black. The upper surfaces of the ramps 26, 28, 30 and 32 and their respective side walls are painted black so that those marble holes which are open to the ramps will appear the same as those marble holes which are closed.

The rules of the game will now be described. The winner of the game will be determined by the first player or partner to get all five of his/her marbles in the opponent's winner's box. Initially, each player will choose five marbles with a die of the same color. The marbles will originally be placed in the colored boxes as discussed above. The player must roll a one or three to get out of their colored box into their start position. Any player rolling the number six loses their turn.

A player can move forward, sideways, or around their home start and in their opponent's or partner's home start circle. No player can enter other areas of the board to reach their opponent's or partner's home start circle. All players must cross the center of the board to reach their opponent's home start. Once the players have reached their opponent's home start, their marble is placed into the winner's box. The players cannot move backwards or diagonally. The players can jump over their opponents but not themselves. Once the player sets down a marble, the player cannot change his/her mind.

Any marble falling into the compartment 25 must be returned to its respective colored box for future play. Marbles are replayed when a player's marble falls into a marble hole into the compartment or when a player is sent home by themselves or by their opponent when a player lands on an occupied marble space including their own home start. All players' marbles are replayed from their colored box.

The game may be played with partners with the same rules applying except that when a player gets all of their marbles in their partner's winner's box the partner continues to roll his/her die allowing their partner to use their turn in helping to get to their winner's box. When both partners have all their marbles in the winner's box, they win the game.

In a second embodiment, only two player's stations are provided.

Thus it can be seen that a novel marble game has been provided which accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. A marble board game for two to four players, comprising:

a horizontally disposed bottom wall having a first side edge, a second side edge, a third side edge, and a fourth side edge;

first, second, third and fourth upstanding side walls extending upwardly from said first, second, third and fourth side edges of said bottom wall respectively;

a horizontally disposed playing board extending between the upper ends of said first, second, third and fourth side walls to define a compartment between said playing board and said bottom wall;

said playing board having a first side, a second side, a third side, a fourth side, an upper surface and a lower side;

said first side wall having a first marble retrieving opening formed therein;

said second side wall having a second marble retrieving opening formed therein;

said third side wall having a third marble retrieving opening formed therein;

said fourth side wall having a fourth marble retrieving opening formed therein;

a first colored box on said upper surface of said playing board adjacent said first side thereof which is adapted to receive a plurality of marbles therein having a first color;

a second colored box on said upper surface of said playing board adjacent said second side thereof which is adapted to receive a plurality of marbles therein having a second color;

a third colored box on said upper surface of said playing board adjacent said third side thereof which is adapted to receive a plurality of marbles therein having a third color;

a fourth colored box on said upper surface of said playing board adjacent said fourth side thereof which is adapted to receive a plurality of marbles therein having a fourth color;

a first winner's box on said upper surface of said playing board adjacent said first side thereof which is adapted to receive marbles;

a second winner's box on said upper surface of said playing board adjacent said second side thereof which is adapted to receive marbles therein;

a third winner's box on said upper surface of said playing board adjacent said third side thereof which is adapted to receive marbles therein;

a fourth winner's box on said upper surface of said playing board adjacent said fourth side thereof which is adapted to receive marbles therein;

a first player's station on said upper surface of said playing board adjacent said first side thereof;

a second player's station on said upper surface of said playing board adjacent said second side thereof;

a third player's station on said upper surface of said playing board adjacent said third side thereof;

a fourth player's station on said upper surface of said playing board adjacent said fourth side thereof;

said first player's station including a start position adapted to have a plurality of the marbles in a spaced-apart manner having said first color positioned therein;

said second player's station including a start position adapted to have a plurality of the marbles having said second color positioned therein in a spaced-apart manner;

said third player's station including a start position adapted to have a plurality of the marbles having said third color positioned therein in a spaced-apart manner;

said fourth player's station including a start position adapted to have a plurality of the marbles having said fourth color positioned therein in a spaced-apart manner;

said first player's station including a plurality of spaced-apart rows of spaced-apart marble holes which are formed in said playing board;

said rows of marble holes of said first player's station being parallel to said first side of said playing board;

said second player's station including a plurality of spaced-apart rows of marble holes which are formed in said playing board;

said rows of marble holes of said second player's station being parallel to said second side of said playing board;

said third player's station including a plurality of spaced-apart rows of marble holes which are formed in said playing board;

said rows of marble holes of said third player's station being parallel to said third side of said playing board;

said fourth player's station including a plurality of spaced-apart rows of marble holes which are formed in said playing board;

said rows of marble holes of said fourth player's station being parallel to said fourth side of said playing board;

said rows of marble holes of said first player's station having an outer row of marble holes, an inner row of marble holes and intermediate rows of marble holes between said outer and inner rows of marble holes thereof;

said rows of marble holes of said second player's station having an outer row of marble holes, an inner row of marble holes and intermediate rows of marble holes between said outer and inner rows of marble holes thereof;

said rows of marble holes of said third player's station having an outer row of marble holes, an inner row of marble holes and intermediate rows of marble holes between said outer and inner rows of marble holes thereof;

said rows of marble holes of said fourth player's station having an outer row of marble holes, an inner row of marble holes and intermediate rows of marble holes between said outer and inner rows of marble holes thereof;

said playing board having a center marble hole positioned at the center thereof;

said first player's station including a plurality of aligned marble holes formed in said playing board which are positioned between said center marble hole and the center of said inner row of marble holes thereof;

said second player's station including a plurality of aligned marble holes formed in said playing board which are positioned between said center marble hole and the center of said inner row of marble holes thereof;

said third player's station including a plurality of aligned marble holes formed in said playing board which are positioned between said center marble hole and the center of said inner row of marble holes thereof;

said fourth player's station including a plurality of aligned marble holes formed in said playing board which are positioned between said center marble hole and the center of said inner row of marble holes thereof;

at least some of said marble holes in said rows of marble holes of said first, second, third and fourth player's station being closed to prevent a marble from passing downwardly therethrough into said compartment;

at least some of the marble holes in said rows of marble holes of said first player's station being open to said compartment whereby a marble placed therein will fall into said compartment and returned to said first marble retrieving opening in said first side wall by said first marble return structure for subsequent manual return to said first colored box for further play;

at least some of said marble holes in said rows of marble holes of said second player's station being open to said compartment whereby a marble placed therein will fall into said compartment and returned to said second marble retrieving opening in said second side wall by said second marble return structure for subsequent manual return to said second colored box for further play;

at least some of said marble holes in said rows of marble holes of said third player's station being open to said compartment whereby a marble placed therein will fall into said compartment and returned to said third marble retrieving opening in said third side wall by said third marble return structure for subsequent manual return to said third colored box for further play;

at least some of said marble holes in said rows of marble holes of said fourth player's station being open to said compartment whereby a marble placed therein will fall into said compartment and return to said fourth marble retrieving opening in said fourth side wall by said fourth marble return structure for subsequent manual return to said fourth colored box for further play.

2. The board game of claim 1 wherein said center opening is closed.

3. The board game of claim 1 wherein the rows of marble holes of said first, second, third and fourth player's station are partially enclosed within a circle printed on said playing board.

4. The board game of claim 1 wherein those marble holes which are closed have the same color as said compartment so that those marble holes which are open will appear to be closed.

5. The board game of claim 1 further including a die at each player's station.

6. The board game of claim 5 wherein each of said die has at least one blank face.

7. The board game of claim 5 wherein the numbers on the faces of the dice are varied.

8. The board game of claim 1 wherein some of the marble holes extending from the inner rows of marble holes of said first, second, third and fourth player stations are closed and wherein some of the openings are open.

9. The board game of claim 8 wherein those marble holes which are closed have the same color as said compartment so that those marble holes which are open will appear to be closed.

10. A marble board game for two players, comprising:

a horizontally disposed bottom wall having a first side edge, a second side edge, a third side edge, and a fourth side edge;

first, second, third and fourth upstanding side walls extending upwardly from said first, second, third and fourth side edges of said bottom wall respectively;

a horizontally disposed playing board extending between the upper ends of said first, second, third and fourth side walls to define a compartment between said playing board and said bottom wall;

said playing board having a first side, a second side, a third side, a fourth side, an upper surface and a lower side;

said first side wall having a first marble retrieving opening formed therein;

said third side wall having a second marble retrieving opening formed therein;

a first colored box on said upper surface of said playing board adjacent said first side thereof which is adapted to receive a plurality of marbles therein having a first color;

a second colored box on said upper surface of said playing board adjacent said third side thereof which is adapted to receive a plurality of marbles therein having a second color;

a first winner's box on said upper surface of said playing board adjacent said first side thereof which is adapted to receive marbles;

a second winner's box on said upper surface of said playing board adjacent said third side thereof which is adapted to receive marbles therein;

a first player's station on said upper surface of said playing board adjacent said first side thereof;

a second player's station on said upper surface of said playing board adjacent said third side thereof;

said first player's station including a start position adapted to have a plurality of the marbles in a spaced-apart manner having said first color positioned therein;

said second player's station including a start position adapted to have a plurality of the marbles having said second color positioned therein in a spaced-apart manner;

said first player's station including a plurality of spaced-apart rows of spaced-apart marble holes which are formed in said playing board;

said rows of marble holes of said first player's station being parallel to said first side of said playing board;

said second player's station including a plurality of spaced-apart rows of marble holes which are formed in said playing board;

said rows of marble holes of said second player's station being parallel to said third side of said playing board;

said rows of marble holes of said first player's station having an outer row of marble holes, an inner row of marble holes and intermediate rows of marble holes between said outer and inner rows of marble holes thereof;

said rows of marble holes of said second player's station having an outer row of marble holes, an inner row of marble holes and intermediate rows of marble holes between said outer and inner rows of marble holes thereof;

said playing board having a center marble hole positioned at the center thereof;

said first player's station including a plurality of aligned marble holes formed in said playing board which are positioned between said center marble hole and the center of said inner row of marble holes thereof;

said second player's station including a plurality of aligned marble holes formed in said playing board which are positioned between said center marble hole and the center of said inner row of marble holes thereof;

at least some of said marble holes in said rows of marble holes of said first and second player's station being closed to prevent a marble from passing downwardly therethrough into said compartment;

at least some of the marble holes in said rows of marble holes of said first player's station being open to said compartment whereby a marble placed therein will fall into said compartment and returned to said first marble retrieving opening in said first side wall by said first marble return structure for subsequent manual return to said first colored box for further play;

at least some of said marble holes in said rows of marble holes of said second player's station being open to said compartment whereby a marble placed therein will fall into said compartment and returned to said second marble retrieving opening in said third side wall by said second marble return structure for subsequent manual return to said second colored box for further play.

11. The board game of claim 10 wherein said center opening is closed.

12. The board game of claim 10 wherein the rows of marble holes of said first and second player's stations are partially enclosed within a circle printed on said playing board.

13. The board game of claim 10 wherein those marble holes which are closed have the same color as said compartment so that those marble holes which are open will appear to be closed.

14. The board game of claim 10 further including a die at each player's station.

15. The board game of claim 14 wherein each of said die have at least one blank face.

16. The board game of claim 14 wherein the numbers on the faces of the dice are varied.

17. The board game of claim 10 wherein some of the marble holes extending from the inner rows of marble holes of said first and second player stations are closed and wherein some of the openings are open.

18. The board game of claim 17 wherein those marble holes which are closed have the same color as said compartment so that those marble holes which are open will appear to be closed.

* * * * *